US011772238B2

(12) United States Patent
Ramirez

(10) Patent No.: US 11,772,238 B2
(45) Date of Patent: Oct. 3, 2023

(54) APPARATUS AND METHOD FOR CONVERTING A SINGLE-STATION VISE TO A DOUBLE-STATION VISE

(71) Applicant: Salvador Ramirez, Pacoima, CA (US)

(72) Inventor: Salvador Ramirez, Pacoima, CA (US)

(73) Assignee: S&R CNC Machining, Inc., Valencia, CA (US)

( * ) Notice: Subject to any disclaimer, the term of this patent is extended or adjusted under 35 U.S.C. 154(b) by 206 days.

(21) Appl. No.: 17/341,232

(22) Filed: Jun. 7, 2021

(65) Prior Publication Data

US 2022/0388124 A1 Dec. 8, 2022

(51) Int. Cl.

| | |
|---|---|
| ***B25B 1/24*** | (2006.01) |
| ***B25B 1/02*** | (2006.01) |
| ***B25B 1/10*** | (2006.01) |

(52) U.S. Cl.

CPC ..... *B25B 1/2478* (2013.01); *B25B 1/02* (2013.01); *B25B 1/10* (2013.01); *B25B 1/103* (2013.01); *B25B 1/2405* (2013.01); *B25B 1/2452* (2013.01)

(58) Field of Classification Search

CPC ..... B25B 1/2478; B25B 1/2452; B25B 1/103; B25B 1/02; B25B 1/04; B25B 1/10

USPC ..... 269/153, 43

See application file for complete search history.

(56) References Cited

U.S. PATENT DOCUMENTS

| | | | | |
|---|---|---|---|---|
| 2,662,433 | A * | 12/1953 | Braun | B25B 5/006 269/244 |
| 6,062,553 | A * | 5/2000 | Strehl | B25B 1/2452 269/282 |
| 6,105,948 | A * | 8/2000 | Young | B25B 1/2478 269/244 |
| 2018/0141187 | A1* | 5/2018 | Hopey | B25B 1/2478 |
| 2019/0366513 | A1* | 12/2019 | Kousens | B25B 1/103 |

OTHER PUBLICATIONS

Double-Vise-Instructions (Steps 1-7) (S&R Products Co.) (Year: 2021).*

Srproductsusa products (Year: 2021).*

Twice the Vise—Convert your single station vise to a dual station vise (S&R Products) (Year: 2021).*

Tutorial—Double Vise Converter (S&R Products) (Year: 2011).*

* cited by examiner

*Primary Examiner* — Mahdi H Nejad

(74) *Attorney, Agent, or Firm* — Roland Tong

(57) ABSTRACT

An apparatus for converting a single-station vise to a double-station vise includes a pair of end converter jaws, a central converter jaw, and two pairs of shafts configured to extend along opposite sides of the single-station vise. Each of the shafts in the first pair is mounted for sliding movement relative to the first end converter jaw and fixed with respect to the second end converter jaw; each of the shafts in the second pair is fixed relative to the first end converter jaw and mounted for sliding movement relative to the second converter jaw; and all of the shafts are mounted for sliding movement relative to the central converter jaw.

8 Claims, 6 Drawing Sheets

APPARATUS AND METHOD FOR CONVERTING A SINGLE-STATION VISE TO A DOUBLE-STATION VISE

BACKGROUND OF THE INVENTION

1. Field of the Invention

The present disclosure relates in general to machine tools, and more particularly, to an apparatus and device for converting a single-station vise to a double-station vise.

2. Background Art

Double-station vises allow machinists to double their productivity by milling two workpieces at a time. However, a good quality double-station vise is very costly, and thus out of reach for many shops. The present disclosure addresses this and other issues by providing an apparatus and method for converting a less costly single-station vise into a double-station vise.

SUMMARY OF THE INVENTION

An apparatus according to the present disclosure includes a pair of end converter jaws, a central converter jaw, and two pairs of shafts configured to extend along opposite sides of the single-station vise. Each of the shafts in the first pair is mounted for sliding movement relative to the first end converter jaw and fixed with respect to the second end converter jaw; each of the shafts in the second pair is fixed relative to the first end converter jaw and mounted for sliding movement relative to the second converter jaw; and all of the shafts are mounted for sliding movement relative to the central converter jaw.

In one aspect of the disclosure, the first end converter jaw is configured to be detachably secured to the stationary jaw of the single-station vise and the second end converter jaw is fixed to the movable jaw of the single-station vise. In one example, the first and second end converter jaws are each configured to receive two sets of fasteners: one set of fasteners for securing the converter jaw to the corresponding jaw of the single-station vise, and another set of fasteners for securing a jaw plate to the converter jaw. In addition, the central converter jaw is configured to receive fasteners for securing jaw plates to both of its sides.

In another aspect of the disclosure, the apparatus includes a stop assembly configured to limit longitudinal translation of the first end converter jaw and the central converter jaw. In one example, the stop assembly includes two pairs of stops: a first pair of stops located between the first end converter jaw and the central converter jaw, and a second pair of stops located between the central converter jaw and the second end converter jaw. Each of the stops includes a body portion mounted for sliding motion along one of the shafts, and a fastener extending through the body portion and movable from a disengaged position allowing sliding motion of the shaft to an engaged position preventing sliding motion of the shaft. A pair of springs is located between the second pair of stops and the central converter jaw.

In still another aspect of the disclosure, each of the converter jaws includes a first set of bores configured to receive the first pair of shafts, and a second set of bores to receive the second pair of shafts. Each shaft includes a first end extending through one of the bores in the first jaw, a second end extending through one of the bores in the second jaw, a first transversely-extending notch formed in the first end, a second transversely extending notch formed in the second end, and a groove extending longitudinally between the first and second notches.

In a method according to the present disclosure, the apparatus described above is placed between the movable and stationary jaws of a single-station vise, the first end converter jaw is fixed to the stationary jaw of the single-station vise, and the second end converter jaw is fixed to the movable jaw of the single-station vise.

In another aspect of the disclosure, the method includes securing jaw plates to the center-facing side of the first and second end converter jaws and to both sides of the central converter jaw; placing a first workpiece between the first end converter jaw and the central converter jaw; placing a second workpiece between the second end converter jaw and the central converter jaw; and moving the movable jaw of the single-station vise toward the stationary jaw of the single-station vise until the workpieces are tightly clamped between the jaw plates.

In still another aspect of the disclosure, the method further includes machining the jaw plates as needed to accept a workpiece having an irregular profile.

In yet another aspect of the disclosure, the apparatus includes a stop assembly as described above, and the method includes tensioning the springs of the stop assembly by sliding the second set of stops toward the central converter jaw; tightening the fasteners extending through the body portions of the second set of stops to prevent further movement of the second set of stops; sliding the first set of stops toward the central converter jaw; and tightening the fasteners extending through the body portions of the first set of stops to prevent further movement of the first set of stops.

DETAILED DESCRIPTION OF THE PREFERRED EMBODIMENT(S)

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
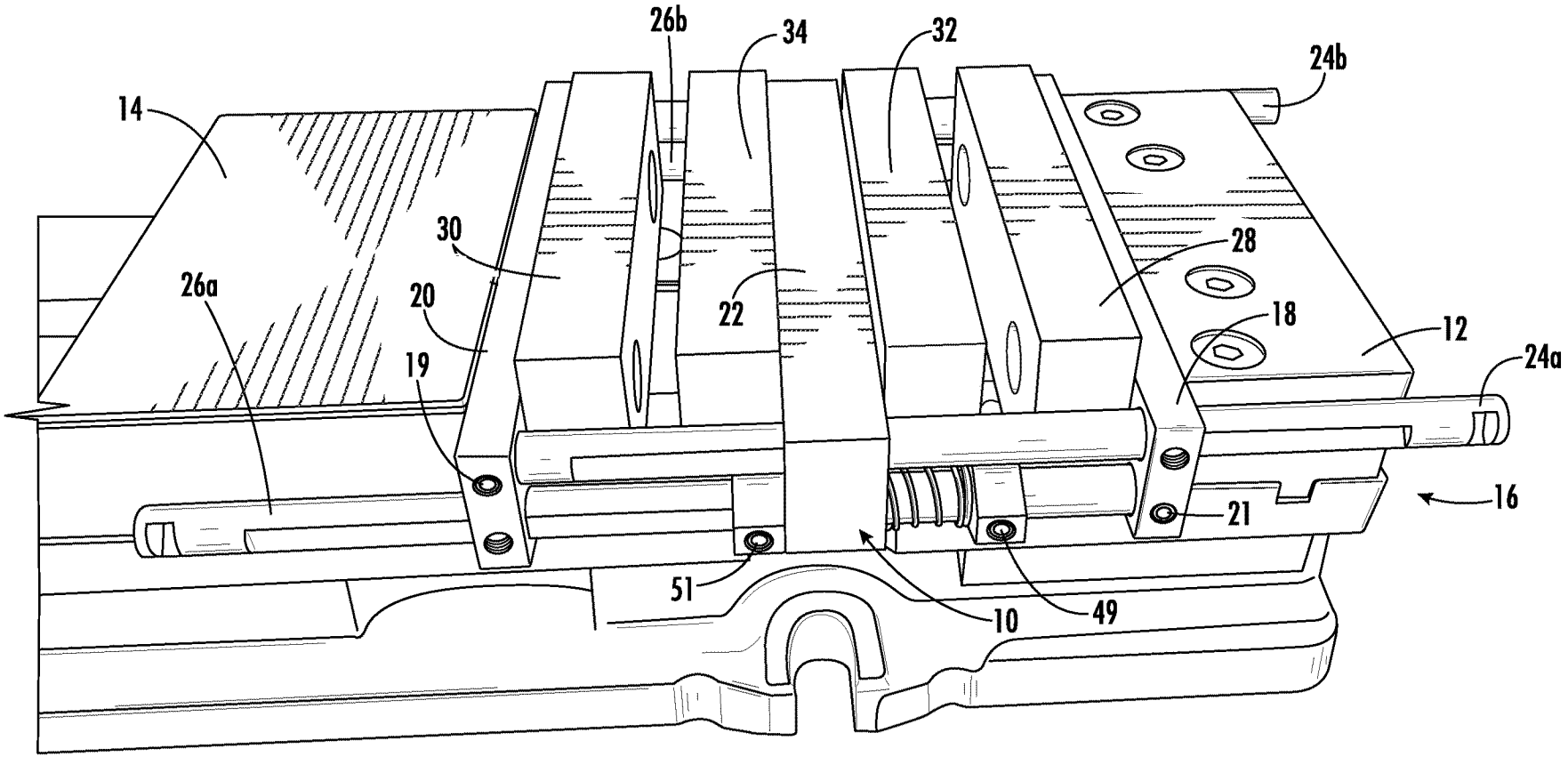
FIG. 1 is a perspective view showing an apparatus according to the present disclosure mounted in the bed of a single-station vise.

FIG. 1 shows an apparatus according to the present disclosure, indicated in its entirety by the numeral 10, mounted between the stationary jaw 12 and the movable jaw 14 of a single station vise 16. The apparatus 10 includes first end converter jaw 18, a second end converter jaw 20, a central converter jaw 22, and a shaft assembly comprising a first pair of shafts 24*a, b* and a second pair of shafts 26 *a, b*. Each of the shafts 24*a*, 24*b* in the first pair is slidable relative to the first end converter jaw 18 and fixed by means of a fastener such as a set screw 19 to the second end converter jaw 20. Each of the shafts 26*a*, 26*b* in the second pair of shafts is fixed by means of a fastener such as a set screw 21 to the first end converter jaw 18 and slidable relative to the second end converter jaw 20. All of the shafts 24*a,b* and 26*a,b* are slidable relative to the central converter jaw 22. The converter jaws 18, 20, 22 and shafts 24*a,b*, 26*a,b* are preferably made of hardened steel.

The first end converter jaw 18 is detachably secured to the stationary jaw 12 of the single-station vise 16, and the second end converter jaw 20 is detachably secured to the movable jaw 14 of the single station vise. A first jaw plate 28 is detachably secured to a surface of the first end converter jaw 18 facing away from the stationary jaw 12, and a second jaw plate 30 is detachably secured to a surface of the second end converter jaw 20 facing away from the movable jaw 14. A third jaw plate 32 is detachably secured to a surface of the central converter jaw 22 facing the stationary jaw 12, and a fourth jaw plate 34 is detachably secured to a surface of the central converter jaw 22 facing the movable jaw 14. When the jaws 12, 14 of the single-station-vise 16 are retracted as shown, a first space is created between the first and third jaw plates 28, 32, allowing for insertion of a first workpiece, and a second space is created between the second and fourth jaw plates 30, 34, allowing for the insertion of a second workpiece. If the workpieces to be milled have long, parallel sides, jaw plates 28, 30, 32, and 34 may be made from hardened steel. If the workpieces have irregular shapes, the jaw plates 28, 30, 32, and 34 may be made from mild steel or even softer materials such as aluminum, so that they may easily be cut to match the profile of the workpieces.

Figure 2:
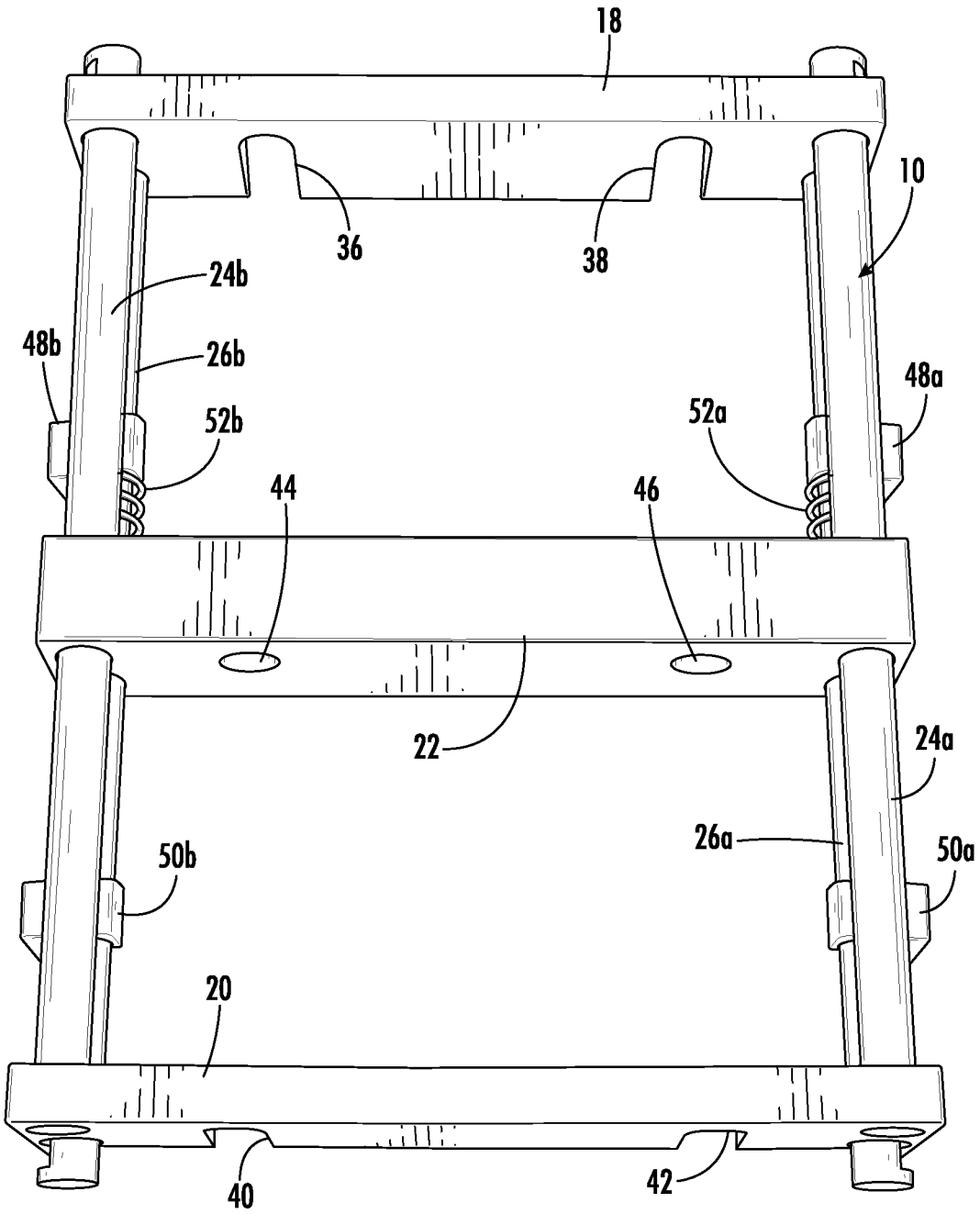
FIG. 2 is a perspective view showing the apparatus.

FIG. 2 shows the apparatus 10 removed from the single-station vise and without the jaw plates. The first end converter jaw 18 includes openings 36, 38 for receiving fasteners such as bolts for attaching the first end converter jaw 18 to the fixed jaw of the single-station vise and the first jaw plate to the first end converter jaw. Similarly, the second end converter jaw 20 includes openings 40, 42 for receiving fasteners such as bolts for attaching the second end converter jaw 20 to the movable jaw of the single-station vise and the second jaw plate to the second end converter jaw. Central converter jaw 22 includes through-holes 44, 46 for receiving fasteners such as bolts for securing the third and fourth jaw plates to opposite sides of the central converter jaw 22.

The apparatus 10 also includes a stop assembly configured to limit longitudinal translation of the first end converter jaw 18 and the central converter jaw 22. The stop assembly comprises a first pair of stops 48*a*, 48*b* located between the central converter jaw 22 and the first end converter jaw 18, and a second pair of stops 50*a*, 50*b* located between the central converter jaw 22 and the second end converter jaw 20. Each of the stops 48*a,b* 50*a,b* is mounted for sliding movement along one of the second pair of shafts 26*a,b* until locked in place by a set screw 49, 51 (seen in FIG. 1) or similar fastener. Springs 52*a*, 52*b* are located between the first pair of stops 48*a*, 48*b* and the central converter jaw 22, urging the central converter jaw 22 away from the first end converter jaw 18. The force exerted on the springs 52*a, b* on the central converter jaw slows the movement of the central converter jaw 22 relative to the movement of the second converter end jaw 20, so that the final size of the opening between central converter jaw 22 and the first end converter jaw 18 may be larger than the final size of the opening between the central converter jaw and the second end converter jaw 18. This allows the converted vise to hold two different-sized workpieces at once.

Figure 3:
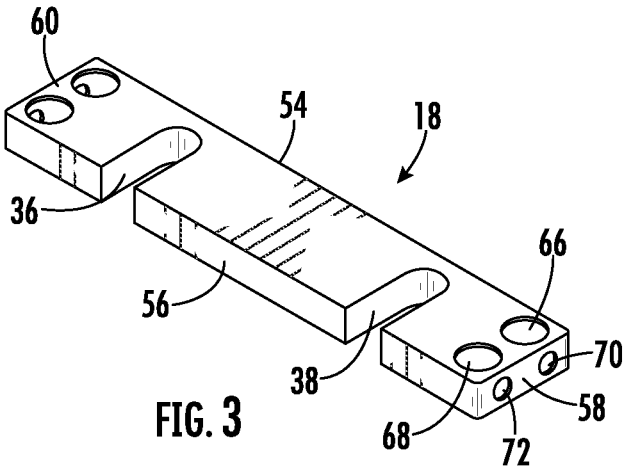
FIG. 3 is a perspective view showing an end jaw plate according to the present disclosure.

First end converter jaw 18, which is identical in structure to second end converter jaw 20, is show in greater detail in FIG. 3. The end jaw 18 is a rectangular element having an upper longitudinal edge 54, a lower longitudinal edge 56, and side edges 58, 60. Openings 36, 38 extend from the lower longitudinal edge 56 toward the upper longitudinal edge. As shown here, each opening 36, 38 has an inverted U shape and is dimensioned to receive two bolts or similar fasteners: one bolt for securing the end jaw to the corresponding jaw of the single-station vise, and another bolt for securing a jaw plate to the end plate. Alternatively, each inverted U-shaped opening could be replaced with a pair of round openings dimensioned to receive a single fastener.

Each side of the end converter jaw defines a pair of vertically aligned openings: a first or upper opening 66 dimensioned to receive one of the shafts in the first pair of shafts in a sliding fit, and a lower opening 68 dimensioned to receive one of the shafts of the second pair of shafts in a sliding fit. Each side edge 58, 60 defines two bores 70, 72 dimensioned to receive a fastener such as a set screw for securing one of the shafts to the end converter jaw. In the case of the first end converter jaw 18, the fastener would be inserted through the lower bores 72 to prevent sliding movement of the second pair of shafts while allowing the first pair of shafts to slide freely through the upper openings 66. In the case of the second converter jaw, the fastener would be inserted through the upper bores 70 to secure the first pair of shafts while allowing the second pair of shafts to slide freely through the lower openings 68.

Figure 4:
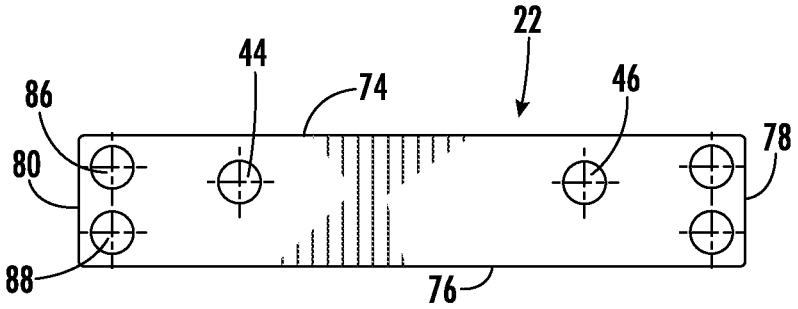
FIG. 4 is a front elevation showing a central jaw plate according to the present disclosure.

The central converter jaw 22, shown in FIG. 4, includes an upper longitudinal edge 74, a lower longitudinal edge 76, two side edges 78, 80, and through-holes 44,46. Each side defines a pair of vertically aligned openings: an upper opening 86 dimensioned to receive one of the shafts in the first pair of shafts in a sliding fit, and a lower opening 88 dimensioned to receive one of the shafts of the second pair of shafts in a sliding fit. These openings 86, 88 are axially aligned with their counterparts 66, 68 in the first and second converter jaws.

Figure 5:
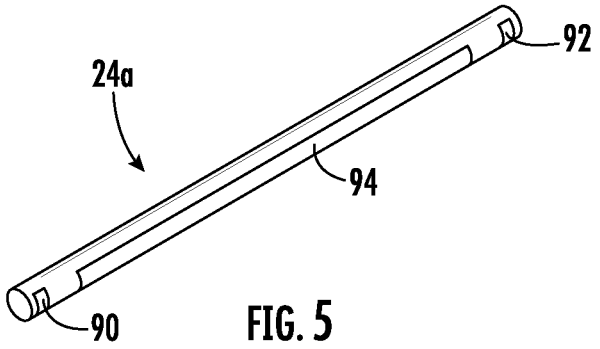
FIG. 5 is a perspective view showing a shaft according to the present disclosure.

Shaft 24*a*, which is identical to shafts 24*b*, 26*a*, and 26*b*, is shown in FIG. 5. A pair of transversely extending notches 90, 92 are formed at opposite ends of the shaft 24*a*. The purpose of these notches is to receive the distal end of the set screw or similar fastener extending through a corresponding bore 72 or 70 in one of the converter end jaws. In the case of the shafts in the first pair (ie. the upper shafts), the notch 90 would receive the distal end of a fastener extending through upper opening 70 in the second end converter jaw, and in the case of the shafts in the second pair (ie. the lower shafts), the notch 92 would receive the distal end of a fastener extending through the lower opening in the first end converter jaw.

Figure 6:
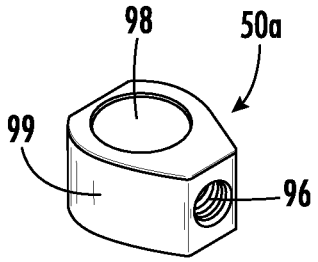
FIG. 6 is a perspective view showing a stop according to the present disclosure.

An elongated groove 94 extends longitudinally between the two notches 90, 92. The purpose of the groove 94 is to receive the distal end of a set screw or other fastener extending though a threaded bore 96 on a side of stop 50*a* (or one of its identical counterparts 50*b*, 52*a* or 52*b*), as shown in FIG. 6. An unthreaded bore 98 extends through the body 99 of the stop 50*a* in a direction perpendicular to the direction of the threaded bore 96. The unthreaded bore 98 is dimensioned to receive one of the shafts in a sliding a fit.

Figure 7A:
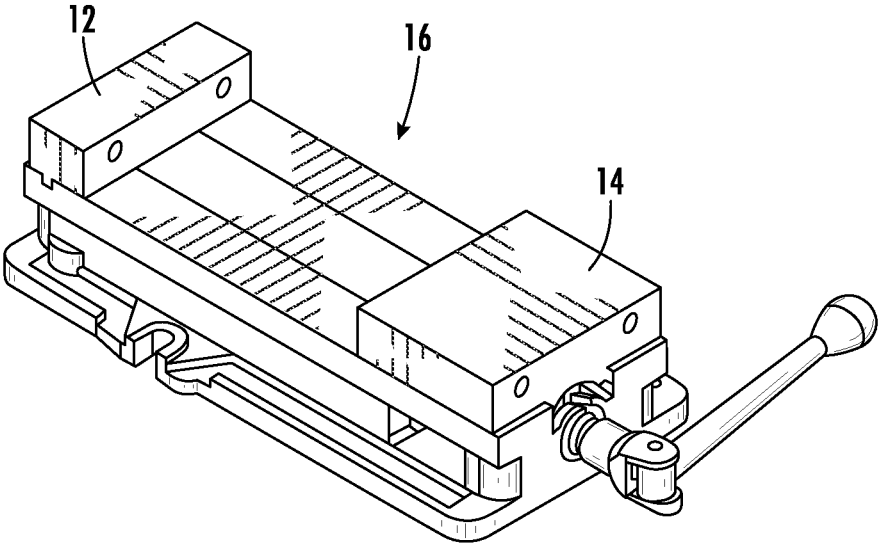
FIGS. 7A-G show a method of converting a single-station vise to a double-station vise according to the present disclosure.
Figure 7B:
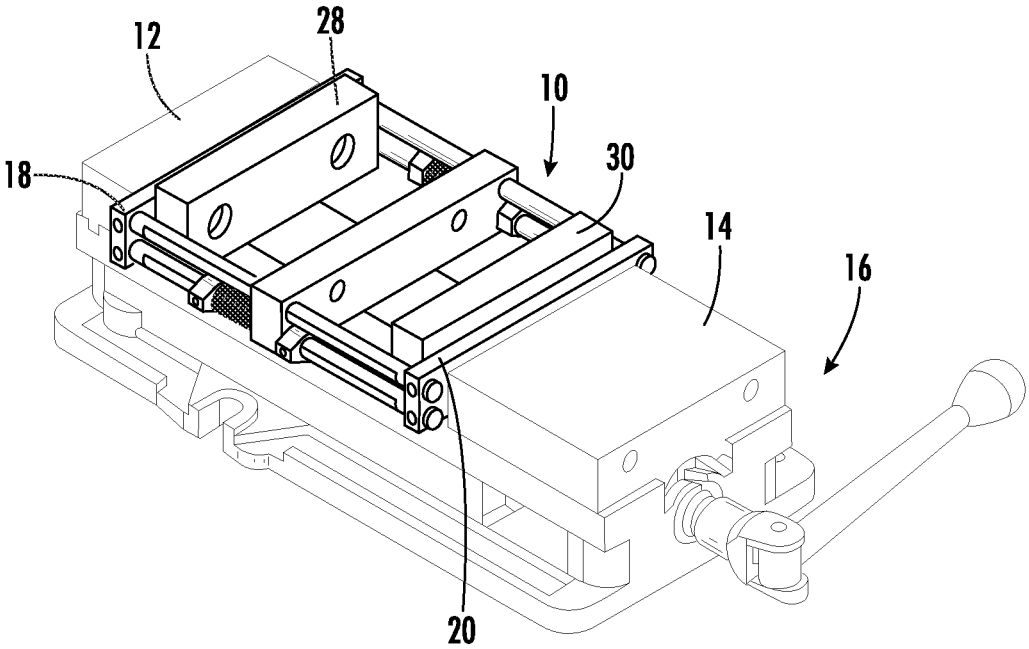
Figure 7C:
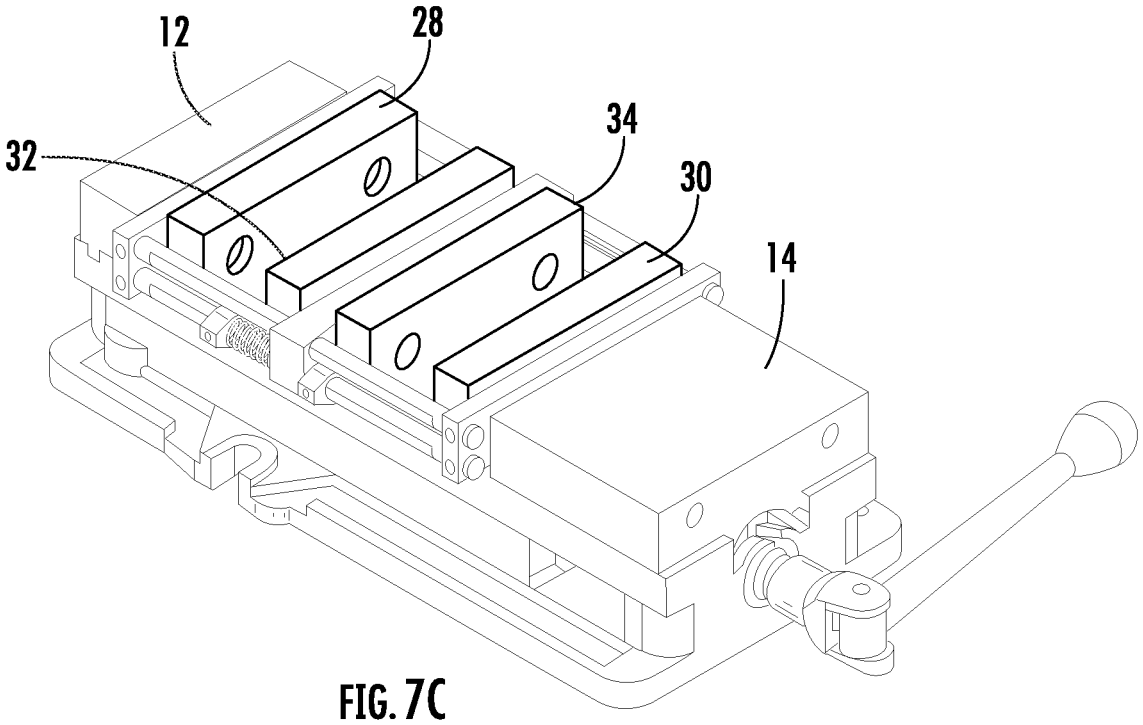

A method of converting a single-station vise to a double station vise according to the present disclosure begins with the single-station vise 16 in an open position as shown in FIG. 7A. Next, a first jaw plate 28 is placed against the surface of the first end converter jaw 18 which faces away from the stationary jaw 12, and a second jaw plate 30 is placed against the surface of the second end converter jaw 20 which faces away from the movable jaw 14, as shown in FIG. 7B. Each jaw plate 28, 30 is then detachably secured to the adjacent end converter jaw 18 or 30 and to the corresponding jaw 12 or 14 of the single-station vise 16 using bolts or similar fasteners that extend through aligned openings in the jaw plates 28, 30, the converter end plates 18, 20, and the single-station vise jaws 12, 14. Once the first and second end converter jaws 18, 20 and first and second jaw plates 28, 30 are secured, the third and fourth jaw plates 32, 34 are inserted on either side of the central converter jaw 33, as shown in FIG. 7C, and secured in place using bolts or similar fasteners.

Figure 7D:
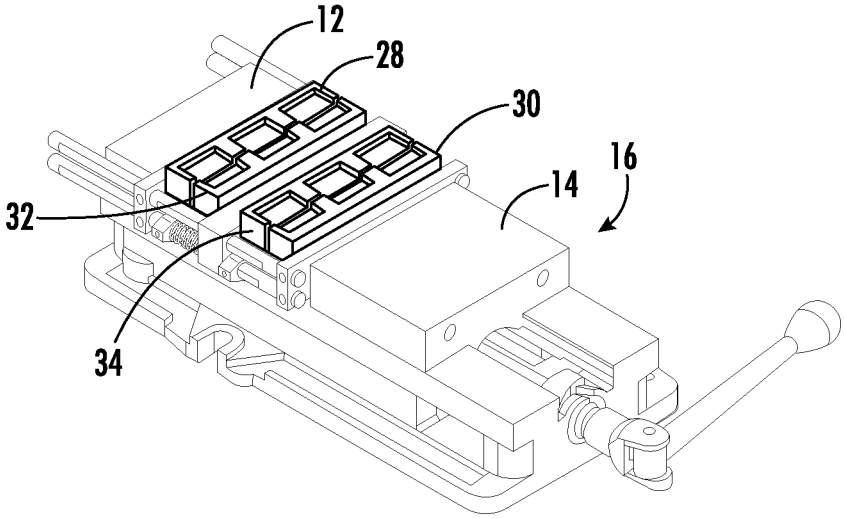

Once the jaw plates 28, 30, 32, and 34 are in place, the movable jaw 14 of the single-station vise 16 is moved toward the fixed jaw 12 until the opposed sets of jaw plates 28, 32 and 30, 34 come into contact with one another, as shown in FIG. 7D. Then, if the workpieces to be clamped in the vise are irregularly shaped, the surfaces of the jaw plates 28, 32, 30, 34 are milled or cut as necessary to match the profile of the workpieces. In the example of FIG. 7D, the jaw plates 28, 30, 32, and 34 have been milled to accept square workpieces.

Figure 7E:
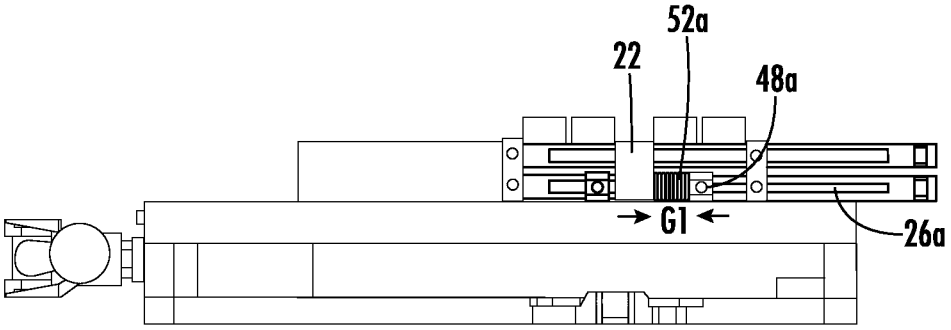

While the vise is still in a closed position, the first stop 48*a* is slid along second shaft 26*a* towards the central converter jaw 22, causing tension in the spring 52*a*, as shown in FIG. 7E. A gap G1 of approximately ¾"' should be left between the first stop 48 and the central converter jaw 22. Once the stop 48*a* is positioned, it is locked in place with a fastener such as a set screw. The process is then repeated on the opposite side of the vise.

Figure 7F:
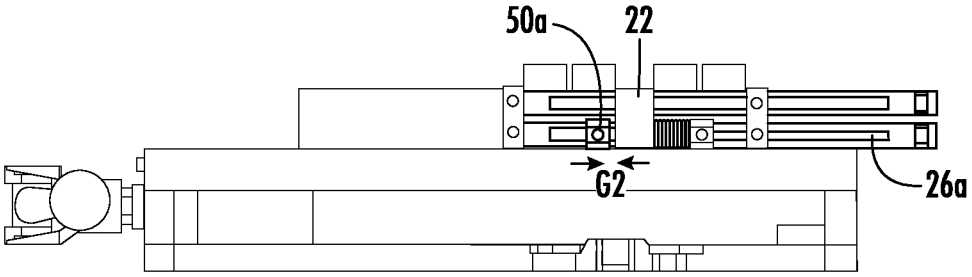

Next, the second stop 50*a* is slid along second shaft 26*a* towards the central converter jaw 22 and locked into a place with fastener such as a set screw, leaving a gap G2 of approximately ⅛" between the second stop 50*a* and the central converter jaw 22, as shown in FIG. 7F. The process is then repeated on the opposite side of the vise.

Figure 7G:
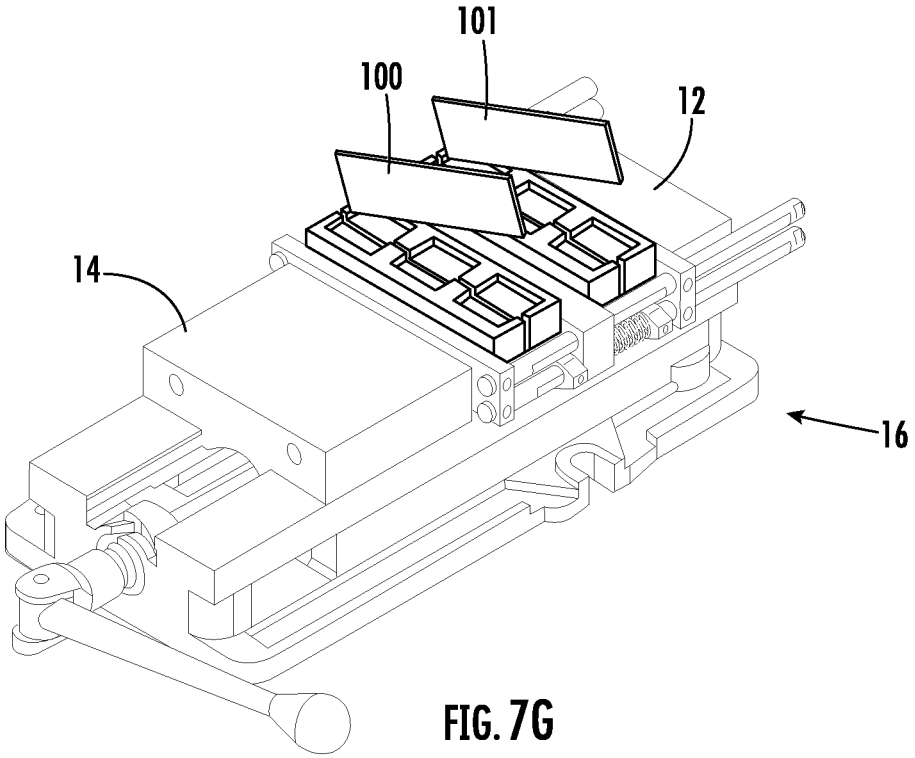

After the stops have been set, movable jaw 14 may be moved back away from stationary jaw 12, creating enough space for workpieces or parallels 100, 101 to be inserted between the jaw plates 28, 32, 30, 34, as shown in FIG. 7G. Once the workpieces have been inserted, the vise is again closed until the workpieces are securely clamped.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for converting a single-station vise having a stationary jaw and a movable jaw to a double-station vise, the method comprising:

a) placing a conversion apparatus between the stationary and movable jaws of the single-station vise, the conversion apparatus including a first end converter jaw;

a second end converter jaw;

a central converter jaw located between the first and second end converter jaws; and a shaft assembly including a first pair of shafts configured to extend along opposite sides of the single-station vise, and a second pair of shafts configured to extend along opposite sides of the single-station vise, wherein each of the shafts in the first pair is mounted for sliding movement relative to the first end converter jaw and fixed with respect to the second end converter jaw, each of the shafts in the second pair is fixed relative to the first end converter jaw and mounted for sliding movement relative to the second converter jaw, and all of the shafts are mounted for sliding movement relative to the central converter jaw;

b) securing the first converter jaw to the stationary jaw of the single-station vise; and c) securing the second converter jaw to the movable jaw of the single station vise.

2. The method according to claim 1, further comprising:

securing a first jaw plate to the first converter jaw;

securing a second jaw plate to the second converter jaw;

securing a third jaw plate to a side of the central converter jaw facing the first converter jaw; and securing a fourth jaw plate to a side of the central converter jaw facing the second converter jaw.

3. The method according to claim 2, further comprising machining each jaw plate as needed to accept a workpiece having an irregular profile.

4. The method according to claim 1, wherein the conversion apparatus further comprises a stop assembly configured to limit longitudinal translation of the first converter jaw and the central converter jaw.

5. The method according to claim 4, wherein the stop assembly comprises:

a first pair of stops located between the first converter jaw and the central converter jaw and configured to stop longitudinal translation of the central converter jaw towards the first converter jaw; and a second pair of stops located between the central converter jaw and the second converter jaw and configured to stop longitudinal translation of the second converter jaw towards the central converter jaw.

6. The method according to claim 5, wherein the stop assembly further comprises a pair of springs located between the first pair of stops and the central converter jaw and configured to urge the central converter jaw away from the first converter jaw.

7. The method according to claim 6, wherein each of the stops comprises:

a body portion mounted for sliding motion along one of the shafts; and a fastener extending through the body portion and movable from a disengaged position allowing sliding motion of the shaft to an engaged position preventing sliding motion of the shaft.

8. The method according to claim 7, comprising: tensioning the pair of springs by sliding the first pair of stops towards the central converter jaw;

tightening the fasteners extending through the body portions of the first pair of stops to prevent further movement of the first pair of stops;

sliding the second pair of stops towards the central converter jaw; and tightening the fasteners extending through the body portions of the second pair of stops to prevent further movement of the second pair of stops.

* * * * *